US005505099A

United States Patent [19]

Tanaka

[11] Patent Number: 5,505,099

[45] Date of Patent: Apr. 9, 1996

[54] APPARATUS FOR INSPECTING AUTOMATIC LOCK SLIDERS FOR SLIDE FASTENERS

[75] Inventor: Akira Tanaka, Kurobe, Japan

[73] Assignee: YKK Corporation, Tokyo, Japan

[21] Appl. No.: 315,617

[22] Filed: Sep. 30, 1994

[30] Foreign Application Priority Data

Oct. 19, 1993 [JP] Japan ..... 283846

[51] Int. Cl.[6] ..... F16H 21/44

[52] U.S. Cl. ..... 73/865.9; 74/110

[58] Field of Search ..... 73/865.9, 865.3, 73/818, 823; 209/509, 552, 576, 577, 600; 74/110, 404, 413

[56] References Cited

U.S. PATENT DOCUMENTS 4,928,517 5/1990 Fitts ..... 73/105

FOREIGN PATENT DOCUMENTS 2184540 7/1990 United Kingdom .

*Primary Examiner*—Robert Raevis

*Attorney, Agent, or Firm*—Hill, Steadman & Simpson

[57] ABSTRACT

An apparatus for inspecting automatic lock sliders comprises a table for horizontally holding and intermittently moving sliders, an elevating board disposed above the table and adapted to be reciprocated vertically at a predetermined stroke while the table is at a stop, an auxiliary support block attached slidably to the elevating board so as to be vertically reciprocated above the slider held on the table, and a retainer rod and a pressure rod both attached to the auxiliary support block as allowed to reciprocate vertically and elastically urged downwardly. By interposing a decelerating mechanism between the elevating board and the auxiliary support block, the speed of reciprocation of the retainer rod and the pressure rod is decreased relative to that of the elevating board just before and after a sensing projection of a sensor lever pivotally supported on the retainer rod collides against a pull tab of the slider and the otherwise possible accidental jump of the sensor lever due to the collision is prevented. The inspection of the slider to discriminate between acceptability and rejectability thereof is attained by causing the pressure rod to exert pressure on the pull tab and detecting the motion of the sensor lever owing to the pivotal movement of the pull tab caused by the pressure.

17 Claims, 6 Drawing Sheets

APPARATUS FOR INSPECTING AUTOMATIC LOCK SLIDERS FOR SLIDE FASTENERS

BACKGROUND OF THE INVENTION

1. Field of the Invention

This invention relates to an apparatus for inspecting automatic lock sliders incorporated in slide fasteners and used therein for opening and closing them, and more particularly to an apparatus for automatically inspecting the assembled sliders to determine infallibly by a simple mechanism whether or not the sliders are capable of fulfilling a prescribed automatic locking function.

2. Description of the Prior Art

The automatic lock slider for a slide fastener is provided with an engaging claw which is thrust elastically into a fastener chain guide channel inside a slider body by a spring set in the upper plate of the slider body. When a pair of long and narrow slide fastener chains having interlocking elements or fastener elements attached as regularly spaced to the lateral edges thereof are held in the guide channel inside the slider body and the engaging claw is thrust into the guide channel and then inserted in the gap between adjacent elements by the force of the spring, the slider is brought into engagement with the slide fastener chains by the engaging claw and is no longer allowed to slide. When the engaging claw is lifted up in spite of the force of the spring and extracted from the gap between the adjacent elements by the use of a pull tab, the slider is released from the engagement with the slide fastener chains and consequently allowed to slide on the slide fastener chains and open or close the slide fastener. In order for the slider to lock and unlock the slide fastener chains smoothly in consequence of the use of the pull tab, therefore, the spring for urging the engaging claw must be possessed of prescribed spring force.

The slider mentioned above is generally assembled as a finished product by sequentially setting a plurality of parts such as the pull tab, the spring, and the cover in place in the slider body. Owing to possible variations in the qualities of these parts and in the conditions of assembly works, the assembled sliders have inevitably included defective products.

The apparatus disclosed in GB 2184540B has been known as inspection means intended for efficiently detecting and eliminating these defective products at the final stage of the process of production. This inspection apparatus comprises a table for horizontally supporting and intermittently moving sliders, a vertically movable disk or elevating disk disposed above the table and vertically reciprocated at a predetermined stroke while the table is at a stop, a retainer rod for retaining a slider body in a peripheral recess of the table and a pressure rod for pressing a pull tab of the slider, severally mounted vertically movably on a support block fixed to the elevating disk as elastically urged downwardly, a sensor lever pivotally supported on the lower part of the retainer rod and extended in a substantially horizontal direction, the sensor lever having a sensing projection extended downwardly from the middle portion thereof so as to collide against the pull tab of the slider, a detecting unit possessing a pair of upper and lower non-contact type detectors disposed within the range in which the free end of the sensor lever produces a vertical motion, and an electric-signal discrimination circuit connected to the detecting unit.

This inspecting apparatus accomplishes detection of a defective slider on the principle that the condition of contact of the sensing projection with the pull tab of the slider held on the table and the vertical motion of the free end of the sensor lever due to the pressure exerted by the pressure rod are different between a non-defective slider and a defective slider, this difference induces a difference in the signal from the detecting unit, and the electric-signal discrimination circuit, on receiving the signal, discerns the presence or absence of a defect in the slider under inspection. Then, the electric-signal discrimination circuit controls the operation of means for discharging sliders from the table in accordance with the result of discernment between the non-defective and defective conditions.

Incidentally, in the apparatus for automatic assembly of sliders, the table and the elevating disk mentioned above are synchronously operated and the apparatus, therefore, is allowed to perform a series of works ranging from assembly through inspection. To be specific, the table is divided into several sections such as a slider body supply section, a pull tab fitting section, a spring fitting section, a spring fixing section, a cover fitting section, and a inspection section, the elevating disk is provided in the areas or vicinities thereof corresponding to the sections mentioned above with machining devices suitable for the works to be performed in the sections, and the slider bodies held on the table are moved intermittently by the table and subjected sequentially to the works.

For the purpose of expediting the component works of the process ranging from assembly to inspection of sliders and improving the productivity of the process, therefore, it is necessary that the speed of the intermittent motion of the table should be increased and the speed of the vertical motion of the elevating disk or board should be proportionately increased. As a result, the overall speed of the process will be heightened.

When the inspecting apparatus of the conventional technique mentioned above is used for the process of inspection, however, since the support block which holds the retainer rod and the pressure rod is directly fixed to the elevating board, an increase in the speed of vertical reciprocation of the elevating board inevitably adds to the speed of vertical reciprocation of the support block and that of the retainer rod and the pressure rod supported thereon as well. As a result, the sensor lever which is pivotally supported at one point by the retainer rod fails to follow the speed of vertical reciprocation and collides at a relatively high speed against the pull tab of the slider. The repulsive force arising from this collision causes the sensor lever to jump and entails the problem that the apparatus will provide no precise inspection as by committing the error of rating a non-defective slider as a defective slider.

SUMMARY OF THE INVENTION

A primary object of the present invention is to provide an apparatus for inspecting automatic lock sliders for slide fasteners, which apparatus provides the assembled sliders with precise inspection for discrimination between acceptability and rejectability of the products without entailing the problem of causing the sensor lever to jump owing to rapid collision thereof against the pull tab of the slider and consequently compelling the apparatus to commit the error of rating a non-defective slider as a defective slider even when measures are taken to expedite the series of works ranging from assembly to inspection.

Another object of the present invention is to provide a decelerating mechanism for the apparatus for inspecting automatic lock sliders, which mechanism being capable of decreasing the speeds of vertical reciprocation of the retainer rod supporting the sensor lever and the pressure rod cooperating with the retainer rod relative to the speed of vertical reciprocation of the elevating board just before and after their respective collisions against the slider body and the slider pull tab and adjusting the differences in stroke between the elevating board and the retainer rod and the pressure rod cooperating therewith as well for the purpose of preventing the sensor lever from jumping on collision against the slider pull tab.

In accordance with the present invention, to accomplish the objects described above, there is provided an apparatus for inspecting automatic lock sliders used in slide fasteners, which apparatus comprises a table for horizontally holding and intermittently moving the slider; a vertically movable board or elevating board disposed above the table and adapted to be reciprocated vertically at a predetermined stroke while the table is at a stop; a rack member attached to the elevating board as allowed to reciprocate vertically and elastically urged downwardly and adapted to cease its downward movement when the elevating board has descended over a prescribed distance; an auxiliary support block possessed of a rack part and attached slidably to the elevating board so as to be vertically reciprocated above the slider held on the table, a decelerating mechanism supported on the elevating board and adapted to reverse the rotating force transmitted from the rack member and transmit the reversed rotating force to the rack part of the auxiliary support block, a retainer rod for retaining a slider body, the retainer rod being attached to the auxiliary support block as allowed to reciprocate vertically and elastically urged downwardly; a sensor lever pivotally supported on the retainer rod and extended in a substantially horizontal direction, the sensor lever having a sensing projection extended downwardly from the lower side thereof at a position aligned with a pull tab of the slider held on the table; a pressure rod for pressing the pull tab of the slider, the pressure rod being attached to the auxiliary support block as allowed to reciprocate vertically and elastically urged downwardly; and a detecting unit disposed within the range in which the free end of the sensor lever is vertically movable in response to the pivotal movement of the pull tab of the slider and adapted to detect the motion of the free end of the sensor lever.

BRIEF DESCRIPTION OF THE DRAWINGS

Other objects, features, and advantages of the invention will become apparent from the following description taken together with the drawings, in which:

FIG. 4A depicting the state of the decelerating mechanism prior to collision of a rack member against a table and FIG. 4B the state thereof subsequent to the collision of the rack member against the table;

FIG. 5A depicting the normal state of the slider having no pressure exerted on a pull tab and FIG. 5B the state thereof having the pull tab depressed;

FIG. 7A depicting the state in which the lower end of the sensing projection of the sensor lever is brought into contact with the pull tab of the slider, FIG. 7B the state in which the slider is kept depressed by the lower end of the retainer rod, FIG. 7C the state in which the pull tab of the slider is depressed by the pressure rod, and FIG. 7D the state in which the pull tab of the slider is relieved of the pressure of the pressure rod.

DETAILED DESCRIPTION OF THE PREFERRED EMBODIMENT

Now, a preferred embodiment of the inspection apparatus of the present invention will be described in detail below with reference to the accompanying drawings.

Figure 1:
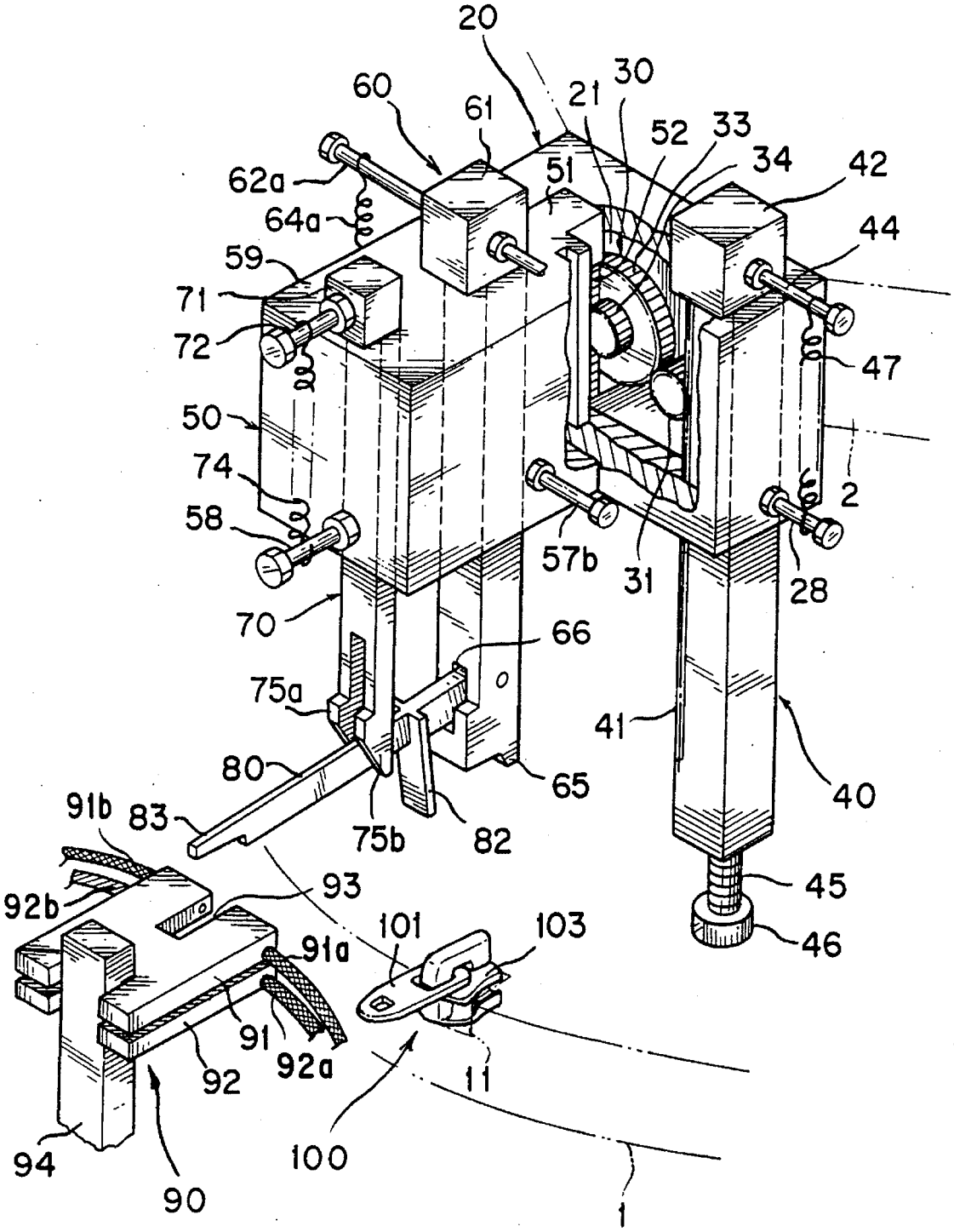
FIG. 1 is a perspective view showing the essential part of one embodiment of the slider inspection apparatus according to the present invention.
Figure 2:
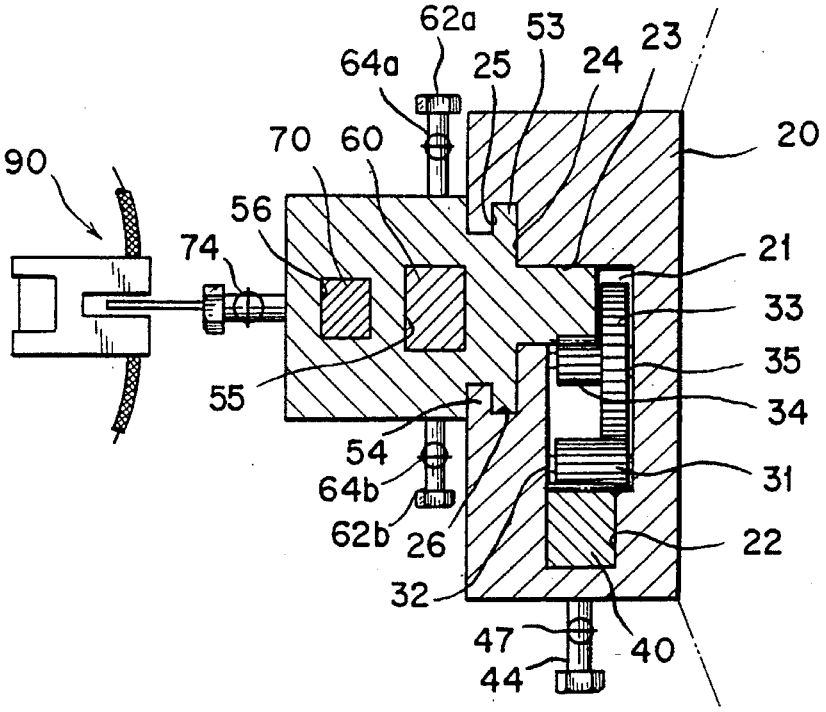
FIG. 2 is a partially sectioned plan view of the inspection apparatus shown in FIG. 1.
Figure 3:
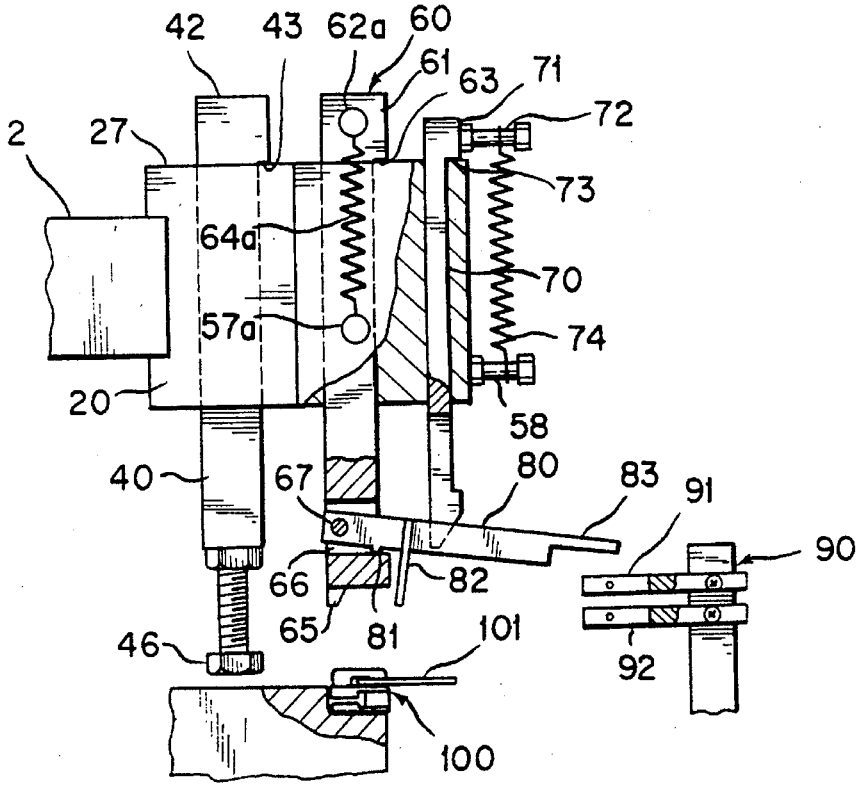
FIG. 3 is a partially sectioned side view of the inspection apparatus shown in FIG. 1.

Referring to FIGS. 1 to 3, reference numeral 1 denotes a disk-like table or turntable which is adapted to rotate around the vertical axis thereof intermittently at a predetermined timing and has a plurality of recesses 11 for receiving respective sliders 100 in and along the peripheral edge of the turntable 1 as disposed at fixed intervals (only one of the recesses is shown and the remainders are omitted in the diagrams). The reference numeral 2 denotes a vertically movable board or elevating board which is disposed above the turntable 1 and synchronized with the intermittent rotation of the turntable 1 so as to descend and ascend at a predetermined stroke while the turntable 1 is at a stop. The elevating board 2 has a supporting block 20 fixed to the lateral edge thereof. As respects the combination of the turntable with the elevating board, an apparatus which comprises a turntable rotatably attached to a vertical supporting shaft, an elevating board fixed on the upper end part of the supporting shaft, a Geneva gear interposed between an input shaft parallel with the supporting shaft and the turntable and adapted to impart an intermittent rotation to the turntable, and an inclined cam mechanism interposed between a ram shaft attached to the supporting shaft and the input shaft and adapted to impart a vertical reciprocation of a predetermined stroke to the elevating board is disclosed in Japanese Utility Model Publication No. SHO 45-7,843 issued to the application filed by the same assignee of this application. The present invention can utilize this apparatus and other similar device. Since this elevating apparatus is well known to persons of ordinary skill in the art, the explanation thereof will be omitted. The turntable 1 is divided into several sections such as a slider body supply section, a pull tab fitting section, a spring fitting section, a spring fixing section, a cover fitting section, and a inspection section. The elevating board is provided in the areas or vicinities thereof corresponding to the sections mentioned above with machining devices suitable for the works to be performed in the sections. Sliders 100 respectively held in the peripheral recesses 11 of the turntable 1 are moved intermittently by the turntable 1 and subjected sequentially to the works. Since the present invention is directed to the inspection section, the other sections will be omitted from the description. Incidentally, where sliders are assembled by the use of a separate turntable-elevating board combination and the assembled sliders are inspected by the turntable-elevating board combination contemplated at present, a device for supplying sliders subjected to the inspection and a device for selectively discharging non-defective and defective sliders which have undergone the inspection are required to be installed.

The support block 20 includes therein a hollow chamber 21. A decelerating mechanism 30 is set in place inside the hollow chamber 21. The decelerating mechanism 30 is composed of a train of gears 31, 33, and 34. The gears 33 and 34 are integrally fixed on one common shaft 35. The shaft 32 of the gear 31 and the shaft 35 are rotatably supported by respective bearings (not shown) buried in the opposite lateral walls of the hollow chamber 21. In one lateral part of the hollow chamber 21, a through hole 22 is formed in the vertical direction. In this through hole 22, a rack member 40 is slidably inserted in the vertical direction so that a toothed face 41 formed on one lateral surface thereof may confront the interior of the hollow chamber 21. The rack member 40 has a head part 42 in the upper end part thereof and a threaded hole (not shown) in the lower end part thereof. A screw 45 possessed of a stopper part 46 is screwed into the threaded hole. The height of the stopper part 46 can be adjusted by turning the screw 45. A coil spring 47 is stretched between a pin 28 projected from the lower lateral part of the support block 20 and a pin 44 projected from the lateral part of the head part 42 of the rack member 40. The rack member 40 is urged by the coil spring 47 downwardly. Since a lower end face 43 of the head part 42 is seated on an upper face 27 of the supporting block 20, the head part 42 is prevented from descending further than the seat.

A depressed part 24 is formed in the vertical direction in front surface of the support block 20 and a pair of lateral grooves 25 and 26 are formed each on the opposite sides of the depressed part 24. A through hole 23 is formed between the depressed part 24 and the hollow chamber 21.

An auxiliary support block 50 has a rack part 51 provided on one lateral side thereof with a toothed face 52 and a pair of lags 53 and 54 projecting from the opposite lateral parts of the rack part 51 and extending in the longitudinal direction thereof. The auxiliary support block 50 is attached slidably in the vertical direction to the support block 20, with the rack part 51 inserted into the through hole 23 in such a manner that the toothed face 52 may confront the interior of the hollow chamber 21 and the lags 53 and 44 respectively inserted in the lateral guide grooves 25 and 26 of the support block 20.

The toothed face 41 of the rack member 40 and the toothed face 52 of the rack part 51 of the auxiliary support block 50, therefore, confront each other inside the hollow chamber 21. The gears 31 and 34 are meshed respectively with these toothed faces 41 and 52.

In the auxiliary support block 50, through holes 55 and 56 are formed parallelly in the vertical direction. A retainer rod 60 and a pressure rod 70 are respectively inserted in the through hole 55 and the through hole 56 on the front side, both slidably in the vertical direction. Coil springs 64*a* and 64*b* are stretched between a pair of pins 62*a* and 62*b* projected from the opposite lateral part of a head part 61 of the retainer rod 60 and a pair of pins 57*a* and 57*b* projected from the lower opposite lateral parts of the auxiliary support block 50. The retainer rod 60 is urged downwardly by the coil springs 64*a* and 64*b*. Since a lower end face 63 of the head part 61 of the retainer rod 60 is seated on an upper face 59 of the auxiliary support block 50, the head part 61 is prevented from descending further than the seat. Similarly, a coil spring 74 is stretched between a pin 72 projected from the front side of a head part 71 of the pressure rod 70 and a pin 58 projected from the front lower part of the auxiliary support block 50. The pressure rod 70 is urged downwardly by the coil spring 74. Since a lower end face 73 of the head part 71 of the pressure rod 70 is seated on the upperface 59 of the auxiliary support block 50, the head part 71 is prevented from descending any further than the seat.

The retainer rod 60 is lowered and utilized for retaining a body 103 of a slider 100 accommodated in the recess 11 of the turntable 1. The retainer rod 60 has in the rear part on the opposite lower end sides thereof a pair of projecting parts 65. These projecting parts 65 retain the opposite lateral parts of the body 103 of the slider 100 and hold the body 103 in place. The lower end part of the retainer rod 60 contains a through hole 66 bored in the horizontal direction and having openings in the front and rear surfaces thereof. One end of a sensor lever 80 is pivotally supported by a horizontal pivot pin 67 inside the through hole 66. A lower end projection 81 of the sensor lever 80 is held in contact with the bottom surface of the through hole 66 and a free end 83 thereof is held in a slightly inclined state by virtue of its own weight. The sensor lever 80 has a sensing projection 82 extended downwardly at a position corresponding to a pull tab 101 of the slider 100 held on the turntable 1. This sensing projection 82 has a length such that the lower end of the sensing projection 82 lies slightly below the lower end of the retainer rod 60 when the sensor lever 80 remains in the inclined state mentioned above and assumes a horizontal position as held in contact with the pull tab 101 of the slider 100 when the projections 65 at the lower end of the retainer rod 60 press the body 103 of the slider 100. Incidentally, the sensor lever 80 must be so light as to avoid affecting the repulsive force of the engaging claw-operating spring of the slider being inspected.

The pressure rod 70 is provided in the lower part thereof with forked pressing parts 75*a* and 75*b* which are disposed astride the sensor lever 80 and consequently prevented from contacting the sensor lever 80. These forked pressing parts 75*a* and 75*b* are utilized for pressing the pull tab 101 of the slider 100 while the projections 65 at the lower end of the retainer rod 60 keep the body 103 of the slider in a retained state. The pressure rod 70 is disposed above the pull tab 101 of the slider 100 and given a length such that the lower ends of the pressing parts 75*a* and 75*b* are positioned above the lower end of the sensing projection 82 of the sensor lever 80.

A detecting unit 90 is disposed within the range in which the free end 83 of the sensor lever 80 is vertically movable in response to the pivotal movement of the sensor lever 80. The detecting unit 90 is composed of a pair of upper limit detecting part 91 and lower limit detecting part 92 which are vertically adjustably attached to a stand 94. The detecting parts 91 and 92 contain vertically aligned cutouts 93, respectively, through which the free end 83 of the sensor lever 80 is allowed to reciprocate vertically. Each of the detecting parts 91 and 92 contains a photoelectric switch having a light emitter 91*a*, 92*a* and a light receptor 91*b*, 92*b* which are severally disposed at the lateral sides of the cutouts 93 and are opposed to each other in the horizontal direction. The photoelectric switches are connected through the medium of suitable control means to an electric-signal discrimination circuit (not shown).

The slider 100 is so held inside the recess 11 of the turntable 1 that the body 103 thereof may lie horizontally and the pull tab 101 in the normal state may extend substantially horizontally to the lateral side of the turntable 1, as shown in FIGS. 1 and 3.

In the inspection apparatus according to the present invention, the elevating board 2 is utilized for causing the retainer rod 60 and the pressure rod 70 to be lowered in the direction of the slider 100 held on the turntable 1, the retainer rod 60 is utilized for retaining the body 103 of the slider 100 in place and, at the same time, causing the sensing projection 82 of the sensor lever 80 pivotally supported on the retainer rod 60 to collide against the pull tab 101 of the slider 100, and the pressure rod 70 is utilized, while retaining the sensor lever 80 substantially in the horizontal state, for pressing the pull tab 101 of the slider 100. Thereafter, the pull tab 101 of the slider is relieved of the pressure exerted by the pressure rod 70. When the assembled slider under inspection possesses a normal function, the pull tab 101 of the slider is vertically moved as the pressure rod 70 starts and ceases exerting pressure thereon, which causes the consequent pivotal movement of the sensor lever 80. The slight vertical motion of the pull tab 101 is enlarged into a large motion of the free end of the sensor lever 80. The detecting unit 90 senses this vertical motion of the sensor lever 80 and, depending on whether this motion is normal or not, rates the assembled slider as a non-defective product or a defective product. When the rate of vertical reciprocation of the elevating board 2 is heightened for the sake of expediting the overall process and, as a consequence, the speed of lowering the retainer rod 60 and the pressure rod 70 is increased as described above, the sensing projection 82 of the sensor lever 80 collides at a relatively high speed against the pull tab 101 of the slider 100 and the sensor lever 80 inevitably jumps and the apparatus performs required accurate inspection with difficulty.

The present invention, therefore, utilizes the auxiliary support block 50 separate from the elevating board 2 or the support block 20 attached thereto. The retainer rod 60 and the pressure rod 70 are attached to this auxiliary support block 50 as allowed to reciprocate vertically and elastically urged downwardly, the auxiliary support block 50 is attached to the elevating board 2 or the support block 20 as allowed to reciprocate vertically, and the decelerating mechanism 30 is interposed between the elevating board and the auxiliary support block. By such an arrangement, the speed of vertical reciprocation of the retainer rod 60 and the pressure rod 70 relative to the speed of vertical reciprocation of the elevating board 2 is decreased just before and after the collision of the sensor projection 82 of the sensor lever 80 against the pull tab 101 of the slider 100 and the difference in stroke between the elevating board 2 and the auxiliary support block 50 is adjusted.

Now, the decelerating mechanism mentioned above will be explained below with reference to the drawings.

Figure 4A:
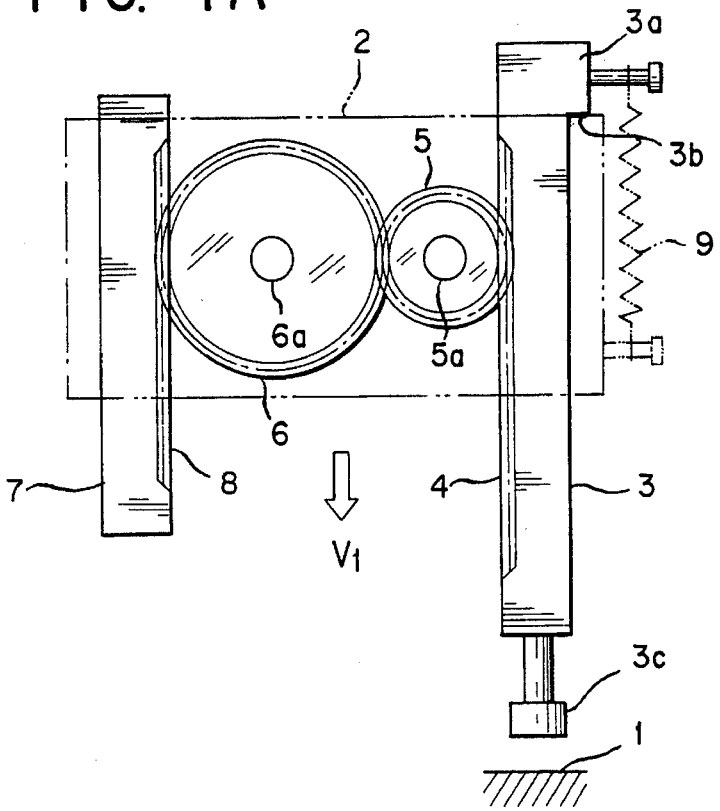
FIGS. 4A and 4B are explanatory diagrams of one embodiment of a decelerating mechanism used in the inspection apparatus of the present invention.
Figure 4B:
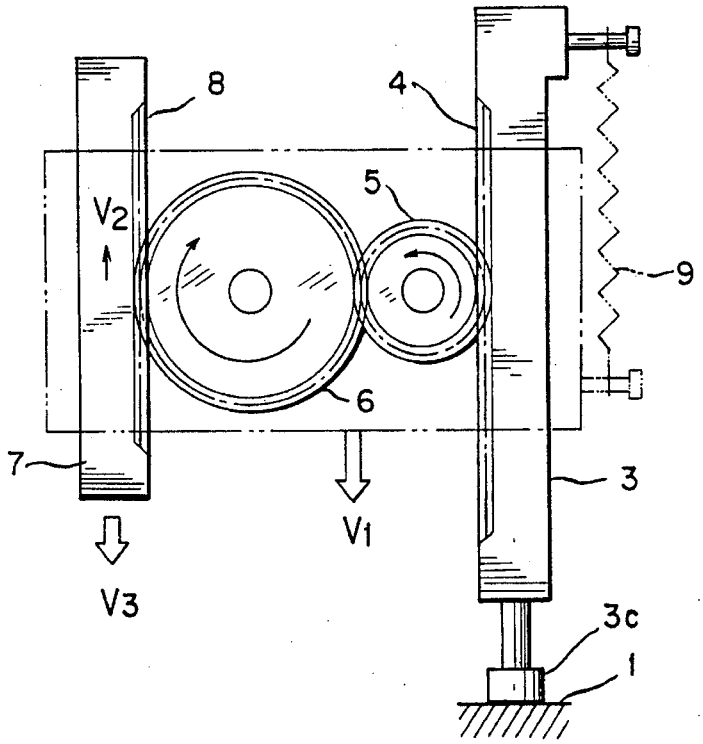

FIGS. 4A and 4B portray the basic concept of the decelerating mechanism using gears. The reference numeral 2 denotes an elevating board or a supporting block attached thereto. Shafts 5*a* and 6*a* of gears 5 and 6 are rotatably supported by the elevating board or supporting block 2. A rack member 3 is attached to the elevating board or supporting block 2 as allowed to reciprocate vertically and is elastically urged downwardly by a spring 9. The reference numeral 7 denotes a rack part of an auxiliary support block holding a retainer rod and a pressure rod. This rack part 7 is attached to the elevating board or supporting block 2 as allowed to reciprocate vertically. Of the mutually meshed gears 5 and 6, the small gear 5 is meshed with teeth 4 of the rack member 3 and the large gear 6 with teeth 8 of the rack part 7. A head part 3*a* of the rack member 3 is urged by the spring 9 in the direction of the elevating board or supporting block 2. The rack member 3 is prevented from falling down by adapting a lower end face 3*b* of the head part 3*a* thereof to collide against the upper face of the elevating board or supporting block 50. The rack part 7 of the auxiliary support block is kept locked by the gears 5 and 6 relative to the rack member 3.

When the elevating board in the existent state is lowered at a speed V1, the rack member 3 and the rack part 7 of the auxiliary support block are lowered in conjunction with the elevating board or support block 2 at the same speed V1. When a lower end part 3*c* of the rack member 3 collides against a suitable stopper, for example, the turntable 1 disposed below the elevating board, after they have been lowered over a prescribed distance, the descent of the rack member 3 is stopped at that time while the elevating board or supporting block 2 continues its descent at the speed V1. Thus, the gear 5 is rotated by the rack member 3 in the direction indicated by an arrow in FIG. 5. The rotating force of the gear 5 is transmitted via the gear 6 and delivered in the form of a reversed rotating force to the rack part 7 of the auxiliary support block, with the result that a force tending to elevate the rack member 7 of the auxiliary support block at a speed V2 is exerted on the rack part 7. Since the entire system including the elevating board or support block 2, the gears 5 and 6, and the rack part 7 are still lowering at the speed V1, the lowering speed V3 of the rack part 7 becomes V3=V1−V2. When the gears 5 and 6 are equal in number of teeth, the relation V1=V2 exists and the rack part 7 comes to a stop. When the ratio of the number of teeth of the gear 6 to the number of teeth of the gear 5 is caused to be greater than 1, the relation V1>V2 exists and the rack part 7 is allowed to descend at the speed V3 which is the difference V1−V2. Owing to the relation V1>V3 which exists in this case, the lowering speed of the retainer rod and the pressure rod just before the collision of the sensing projection of the sensor lever supported by the retainer rod against the pull tab of the slider is decreased relative to the lowering speed of the elevating board and, at the same time, the difference of stroke between the elevating board and the auxiliary support block (and the retainer rod and the pressure rod supported thereby) is adjusted. As a result, the otherwise possible jump of the sensor lever due to the collision of the sensing projection of the sensor lever against the pull tab of the slider is prevented, with the result that the sensor lever will pivot properly about the pivot pin and the inspection will be performed precisely.

When the elevating board ascends, the rack part 7 of the auxiliary support block ascends at the speed reversed in direction from that described above. To be specific, when the elevating board ascends at a speed of [V1], wherein the brackets [] indicate the direction of ascent, the rack part 7 of the auxiliary support block begins to ascend at a speed of [V3]=[V1−V2] until the lower end part 3*c* of the rack member 3 departs from the turntable 1 and returns to the former position (the site of disposition shown in FIG. 4) relative to the elevating board or support block 2 at the time that the lower end part 3*c* of the rack member 3 departs from the turntable 2 and, thereafter, the elevating board or support block 2, the rack member 3, and the rack part 7 of the auxiliary support block as a whole ascend at the speed [V1]. Since the cycle of the process of inspection itself is carried out as a whole at the speed of V1 ([V1]) of the elevating board, the process is consequently sped up.

The elevating or lowering speed of the auxiliary support block which holds the retainer rod and the pressure rod can be set freely by varying the ratio of number of teeth of the small gear 5 to that of the large gear 6. Generally, this ratio is desired to be about 1:5.

Figure 5A:
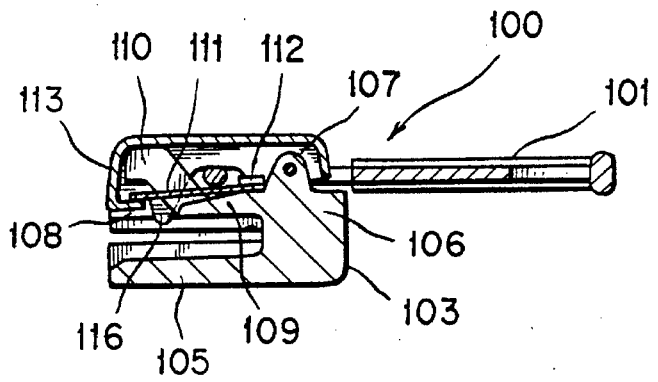
FIGS. 5A and 5B are longitudinal cross sections of one example of an automatic lock slider to be inspected by the inspection apparatus of the present invention.
Figure 5B:
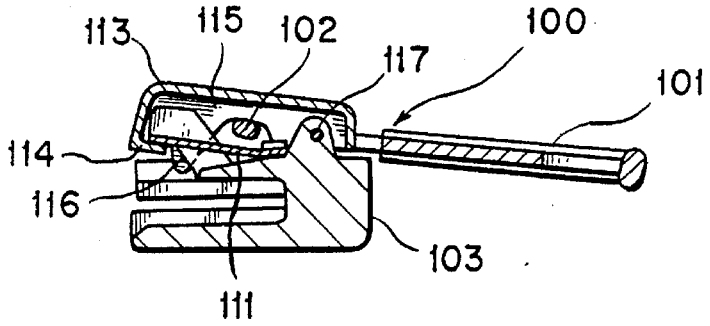
Figure 6:
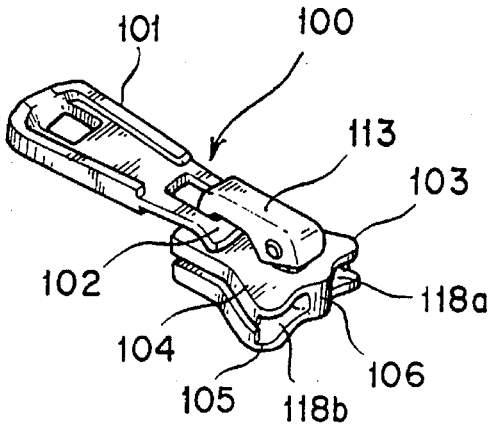
FIG. 6 is a perspective view of the automatic lock slider shown in FIGS. 5A and 5B.

FIGS. 5A, 5B, and 6 illustrate a typical example of the automatic lock slider to be inspected for acceptability or rejectability of the assembly according to the present apparatus. The slider 100 is composed of the pull tab 101, the body 103, a leaf spring or linear spring 111, and a pivotable or liftable cover 113. The body 103 comprises an upper member 104, a lower member 105, and a strut 106 interconnecting these members. The opposite lateral edge parts of the upper member 104 and the lower member 105 are inwardly bent to form guide channels 118*a* and 118*b* for passing the fastener stringers of a slide fastener. The upper member 104 of the body 103 contains a slender slit-like groove 108 extended toward the front from the generally central part thereof. A spring support part 109 is extended forward from the upper part of the strut 106 into the groove 108 while leaving slits on the opposite sides thereof and engaging pieces 110 raised from the opposite sides of the front end part of the spring support part 109 are upwardly projected as inclined toward the front. The slender leaf spring 111 is fixed at one end part thereof to the spring support part 109 with a pin 112 and has the leading end part thereof seated on a part 114 of the cover 113 which is bent inwardly from the lower end part of the front wall thereof and, consequently, functions to urge the cover 113 downwardly. One end part of the cover 113 is rotatably attached to a bracket 107 raised from the upper part of the strut 106 through the medium of a support shaft 117. The cover 113 contains lateral walls 115 each having an arcuately notched lower part. From the lower part of the front side of one of the lateral walls 115 of the cover 113, an engaging claw 116 is projected through one of the slits on the opposite sides of the spring support part 109 into the guide channel 118*a* for the slide fastener. A pintle 102 of the pull tab 101 is laterally inserted between the leaf spring 111 and the arcuately notched parts of the opposite lateral walls 115 of the cover 113.

FIG. 5A illustrates the slider 100 in the state having no pressure exerted on the pull tab 101 thereof. The cover 113 is urged downwardly by the leaf spring 111 and the inner face of the upper wall thereof is held in contact with the upper end of the engaging piece 110 and consequently held in a generally horizontal direction. The engaging claw which now protrudes downwardly from the lower end part of one lateral wall of the cover 113 in its existent state is thrust into the guide channel 118*a* for the slide fastener. The pull tab 101 is also kept in a generally horizontal state.

FIG. 5B illustrates the slider 100 having the pull tab 101 kept in a depressed state. The pintle 102 of the pull tab 101 is raised against the resilience of the leaf spring 111 and, as a result, the cover 113 and the engaging claw 116 are pulled up until the bent part 114 of the cover 113 collides against the lower end of the engaging piece 110. When the pull tab 101 is relieved of the pressure exerted thereon, it is allowed to resume the state shown in FIG. 5A by the force of the leaf spring 111. It is a non-defective product that allows this operation to be performed smoothly with proper pressure. In the case of a defective product which manifests absolutely no automatic locking function because the leaf spring 111 is failed to be mounted in the slider, the pull tab 101 on exposure to the pressure assumes the state shown in FIG. 5B and, even after elimination of the pressure, remains in the state in which the free end of the pulltab 101 is inclined downwardly, as shown in FIG. 5B.

Now, the process of inspection by the use of the apparatus described above will be explained with reference to FIGS. 7A to 7D.

When the turntable 1 is rotated and the slider 101 having the body 103 thereof held in a generally horizontal state inside the recess 11 of the turntable 1 is brought to below the inspection apparatus, the turntable 1 is stopped at this position and the elevating board 2 is lowered. The relation between the lowering speed of the elevating board 2 and the lowering speed of the auxiliary support block 50 (the retainer rod 60 and the pressure rod 70) has been already described with reference to FIGS. 4A and 4B. Thus the lowering speed of the retainer rod 60 and the pressure rod 70 is decreased relative to the lowering speed of the elevating board 2 and the otherwise possible accidental jump of the sensor lever 80 is prevented.

Figure 7A:
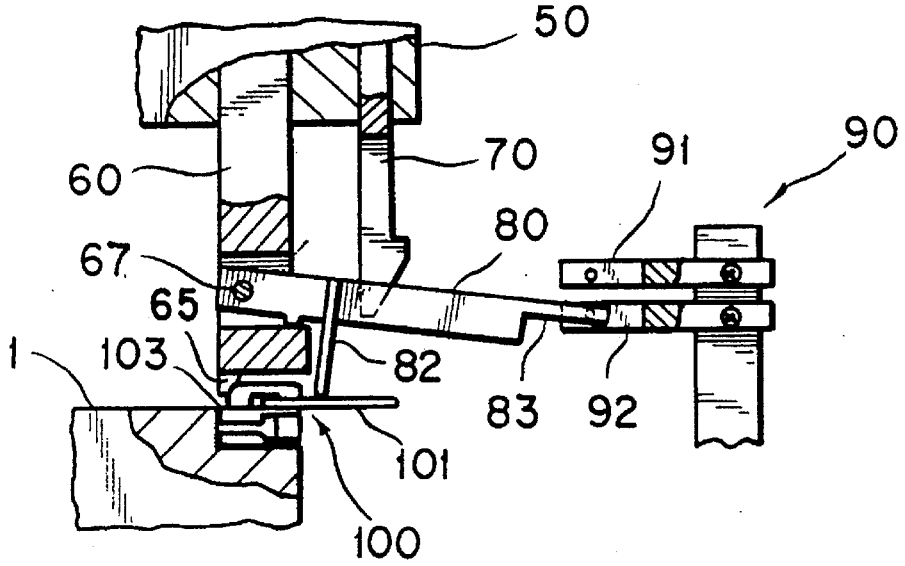
FIGS. 7A to 7D are partially sectioned fragmentary side views to aid in the explanation of the process of inspection performed on a normal non-defective slider.

FIG. 7A illustrates the state in which the projections 65 at the lower end of the retainer rod 60 have not yet contacted the upper face of the body 103 of the slider 100 and the lower end of the sensing projection 82 of the sensor lever 80 has just contacted the upper face of the pull tab 101 of the slider 100 now in a horizontal position. At this time, the detecting parts 91 and 92 of the detecting unit 90 are connected to the electric-signal discrimination circuit. The free end 83 of the sensor lever 80 blocks the light path between the light emitter 92*a* and the light receptor 92*b* of the lower limit detecting part 92.

Figure 7B:
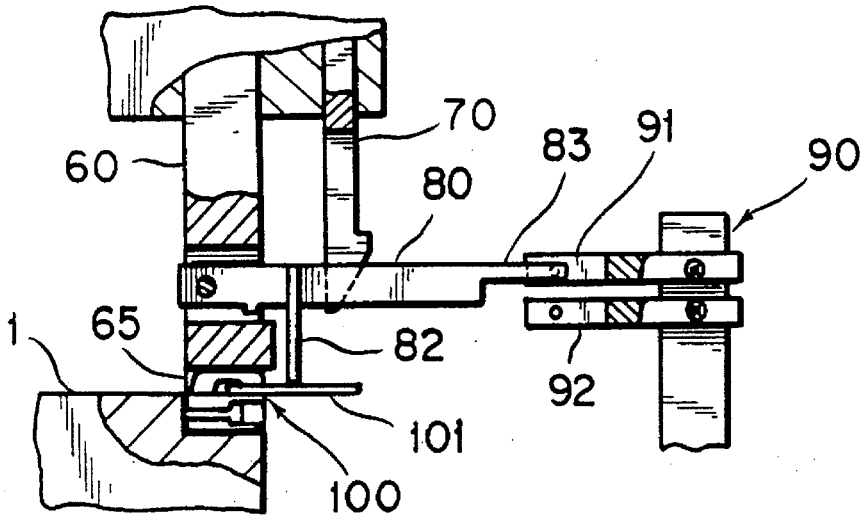

When the auxiliary support block 50 subsequently descends, the projections 65 at the lower end of the retainer rod 60 contact the upper face of the body 103 of the slider 100. When the auxiliary support block 50 further descends, the pressure of the retainer rod 60 generated by the force of the coil springs 64*a* and 64*b* exerts on the body 103 of the slider 100 and takes firm hold of the slider 100 in the recess 11 of the turntable 1 and, at the same time, the sensor lever 80 of light weight is pushed up to a slight extent to pivot counterclockwise about the pivot pin 67 by the sensing projection 82 without being allowed to depress the pull tab 101 elastically held horizontally by the leaf spring 111, and the free end 83 of the sensor lever 80 assumes the state of blocking the light path between the light emitter 91*a* and the light receptor 91*b* of the upper limit detecting part 91, as shown in FIG. 7B.

By the fact that the free end 83 of the sensor lever 80 sequentially blocks the light paths of the upper and lower limit detecting parts 91 and 92 as described above, the normal incorporation of the pull tab 101, the leaf spring 111, and the cover 113 in the slider 100 is detected.

Figure 7C:
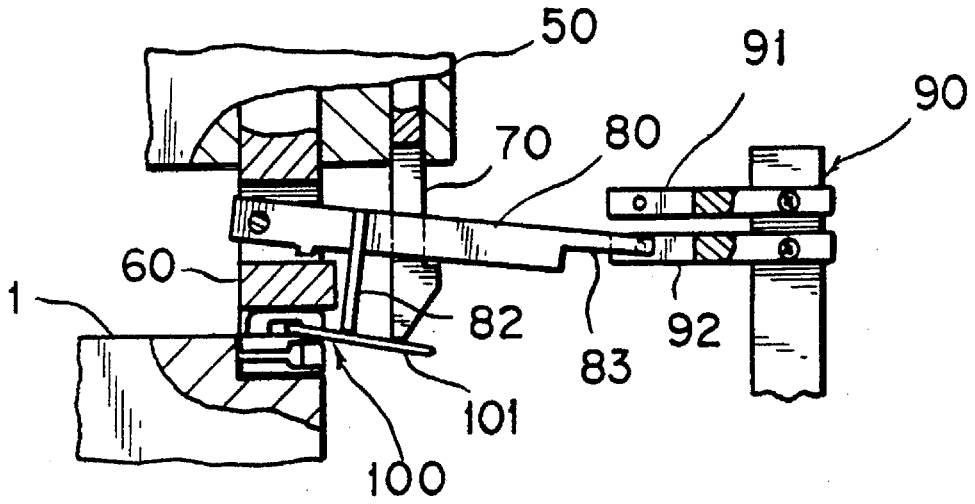
Figure 7D:
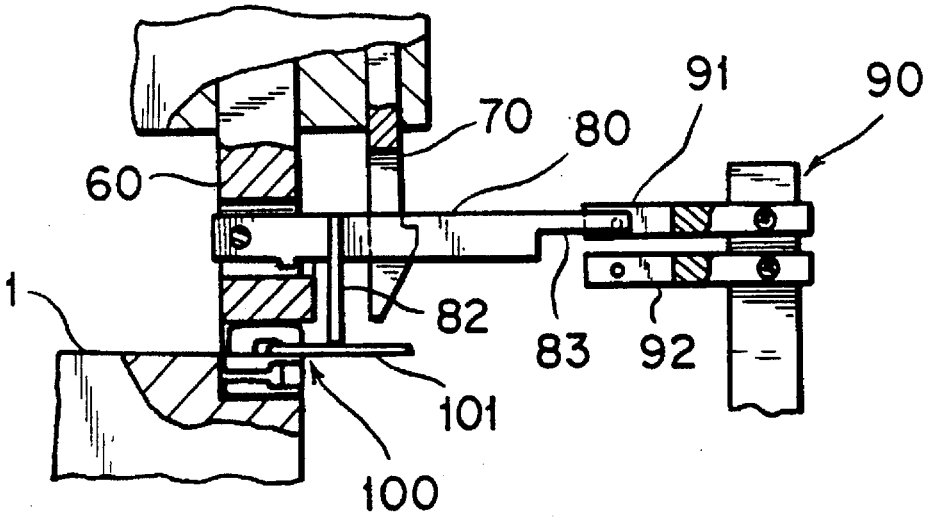

When the auxiliary support block 50 further continues to descend, the retainer rod 60 is enabled by the force of the coil springs 64*a* and 64*b* to take firm hold of the slider 100 in the recess 11 of the turntable 1 and the descending pressure rod 70 meanwhile contacts the upper face of the pull tab 101 and further continues to descend. By the fact that the force of the coil spring 74 surpasses the force of the leaf spring 111 of the pull tab 101, the pull tab 101 is pressed down, as shown in FIG. 7C (to assume the state shown in FIG. 5B). In consequence of this depression of the pull tab 101, the sensor lever 80 assumes an inclined posture sloping downwardly toward its free end and the free end 83 thereof blocks the light path of the lower limit detecting part 92. At this time, the auxiliary support block 50 reaches the lowest point of its downstroke and begins to ascend. When the pressure rod 70 ascends and the pull tab 101 resumes the generally horizontal stake, the free end 83 of the sensor lever 80 again blocks the light path of the upper limit detecting part 91, as shown in FIG. 7D. By the blockage of the light path, the fact that leaf spring 111 of the slider 100 is normally functioning is detected. When the auxiliary support block 50 further ascends and the lower end of the retainer rod 60 slightly departs from the upper face of the slider 100, the detecting parts 91 and 92 of the detecting unit 90 are cut off the electric-signal discrimination circuit. The entire system including the elevating board 2, the auxiliary support block 50, the retainer rod 60, and the pressure rod 70 is further elevated until the state shown in FIG. 3 to complete the process of inspection.

By the fact that the free end 83 of the sensor lever 80 is detected by the upper limit detecting part 91 and the lower limit detecting part 92 of the detecting unit 90 in the order as mentioned above, the slider which has undergone the inspection is rated as a non-defective product.

When the slider being inspected by the process described above happens to be a defective product, the blockage of the light path in the detecting unit 90 occurs under the following conditions which constitute a criterion for detection of a defective product.

When the assembled slider happens to be a defective product which is destitute of such component part as the leaf spring, for example, since the pull tab 101 is remarkably inclined downwardly by its own weight, the sensing projection 82 of the sensor lever 80 fails to contact the pull tab 101 of the slider 100 or only slightly contacts it even if the auxiliary block 50 descends to the extent of connecting the detecting parts 91 and 92 to the electric-signal discrimination circuit. As a result, the free end 83 of the sensor lever 80 still keeps its inclined posture and is barely caused to block the light path of the lower limit detecting part 92.

When the leaf spring 111 incorporated in the slider 100 is rigid with unduly high elasticity or the components are incorrectly incorporated therein, this slider is rated by the apparatus as a defective product because it manifests no smooth automatic locking function even if the pull tab 101 is kept horizontally. In the case of this defective product, even when the pressure rod 70 collides against the pull tab 101 and then the auxiliary support block 50 descends further to depress the pull tab 101 by the pressure rod 70, the pull tab 101 is only slightly slanted and, as a result, the free end 83 of the sensor lever 80 is not detected by the lower limit detecting part 92. Besides, when the pull tab 101 which is at first kept in a horizontal posture is inclined by the first pressure of the pressure rod 70 and is not subsequently allowed to resume the original horizontal posture after the pressure rod 70 is raised, the detection by the upper limit detecting part 91 is not attained.

The electric signal which indicates the detection of such a defective product as described above is different from that indicating the detection of a non-defective product. In accordance with these electric signals, the means for discharging inspected sliders from the turntable 1 can be controlled to effect separation between non-defective products and defective products.

As described above, the inspection apparatus according to the present invention has the decelerating mechanism interposed between the elevating board and the auxiliary support block and, owing to this arrangement, enables the speed of vertical reciprocation of the retainer rod and the pressure rod to be decreased relative to the speed of vertical reciprocation of the elevating board just before and after the collision of the sensing projection of the sensor lever against the pull tab of the slider and permits adjustment of the difference in stroke between the elevating board and the auxiliary support block. Thus, even when the speed of vertical reciprocation of the elevating board is heightened, the sensor lever can properly pivot about the pivot pin without yielding to accidental jump and the apparatus can be operated to effect precise inspection of the assembled sliders infallibly to discriminate between non-defective products and defective products. The fact that the speed of vertical reciprocation of the elevating board can be heightened without fear of affecting the operation of the inspection apparatus contributes to expedite the steps of process ranging from assembly through inspection of sliders and exalt the productivity.

While a preferred embodiment of the present invention has been disclosed herein, it is to be understood that the present invention is not limited thereto but may be embodied in other specific forms without departing from the spirit of the invention. For example, while the embodiment described above has used a turntable as a table, a table of the conveyor type may be used instead. As the detecting unit capable of detecting the pivotal motion of the free end of the sensor lever without contact and emitting an electric signal corresponding thereto, a detecting part incorporating therein a built-in electromagnetic switch may be used, for example, in the place of the detecting part using a built-in photoelectric switch as in the embodiment described above. Further, the inspection apparatus according to the present invention can be applied not only to the slider illustrated in FIGS. 5A, 5B, and 6 but also to sliders of other type incorporating a spring member such as, for example, the slider which, as disclosed in GB 2184540B, has a locking member containing an engaging claw and a spring member interposed between the body of the slider and the cover member fixed thereto. In consequence of the alteration, the lower end face of the retainer rod may be so designed as to conform to the contour of the upper part of the slider to be inspected.

The described embodiment is therefore to be considered in all respects as illustrative and not restrictive, the scope of the invention being indicated by the appended claims rather than by foregoing description and all changes which come within the meaning and range of equivalency of the claims are, therefore, intended to be embraced therein.

What is claimed is:

1. An apparatus for inspecting automatic lock sliders used in slide fasteners, comprising:

(A) a table for horizontally holding and intermittently moving the slider;

(B) an elevating board disposed above said table and adapted to be reciprocated vertically at a predetermined stroke while said table is at a stop;

(C) a rack member attached to said elevating board as allowed to reciprocate vertically and elastically urged downwardly and adapted to cease its downward movement when said elevating board has descended over a prescribed distance;

(D) an auxiliary support block having a rack part and attached slidably to said elevating board so as to be vertically reciprocated above the slider held on said table;

(E) a decelerating mechanism supported on said elevating board and adapted to reverse a rotating force transmitted from said rack member and transmit the reversed rotating force to the rack part of said auxiliary support block;

(F) a retainer rod for retaining a slider body, the retainer rod being attached to said auxiliary support block as allowed to reciprocate vertically and elastically urged downwardly;

(G) a sensor lever pivotally supported on said retainer rod and extended in a substantially horizontal direction, the sensor lever having a sensing projection extended downwardly from a lower side thereof at a position aligned with a pull tab of the slider held on said table;

(H) a pressure rod for pressing the pull tab of the slider held on said table, the pressure rod being attached to said auxiliary support block as allowed to reciprocate vertically and elastically urged downwardly; and (I) a detecting unit disposed within a range in which a free end of said sensor lever is vertically movable in response to the pivotal movement of said pull tab of the slider and adapted to detect the motion of the free end of said sensor lever.

2. An apparatus according to claim 1, wherein said decelerating mechanism comprises a train of gears supported by said elevating board, the train of gears being meshed on one side with teeth of said rack member and on the other side with teeth of the rack part of said auxiliary support block.

3. An apparatus according to claim 1, wherein said elevating board is provided with a support block containing a hollow chamber, said rack member and the rack part of said auxiliary support block are disposed inside said hollow chamber in such a manner that toothed faces of said rack member and said rack part may be opposed to each other, and said decelerating mechanism is composed of a train of gears adapted to adjust the difference in stroke between said elevating board and said auxiliary support block, the train of gears being supported by said support block and meshed on one side with teeth of said rack member and on the other side with teeth of the rack part of said auxiliary support block.

4. An apparatus according to claim 1, wherein said table is a disk-like turntable intermittently turnable on its vertical axis and having a plurality of recesses in and along a peripheral edge thereof at predetermined distances for receiving the sliders one in each of said recesses.

5. An apparatus according to claim 1, wherein said rack member is vertically slidably attached to said elevating board and normally urged downwardly by a spring.

6. An apparatus according to claim 3, wherein said rack member is vertically slidably attached to said support block and normally urged downwardly by a spring.

7. An apparatus according to claim 1, wherein said retainer rod is vertically slidably attached to said auxiliary support block at a position aligned with a body of the slider held on said table and normally urged downwardly by a spring.

8. An apparatus according to claim 1, wherein said retainer rod has a lower end face so designed as to conform to the contour of an upper part of the slider to be inspected.

9. An apparatus according to claim 1, wherein said pressure rod is vertically slidably attached to said auxiliary support block at a position aligned with a pull tab of the slider held on said table and normally urged downwardly by a spring.

10. An apparatus according to claim 1, wherein said pressure rod is provided in its lower part with forked parts adapted to be disposed astride said sensor lever.

11. An apparatus according to claim 1, wherein said detecting unit includes a pair of upper and lower non-contact type detectors.

12. An apparatus according to claim 11, wherein said upper and lower detectors have a pair of vertically aligned cutouts, respectively, for passage of the free end of said sensor lever, each of said upper and lower detectors having a light emitter disposed at one side of the respective cutout and a light receptor disposed at the other side thereof.

13. An apparatus according to claim 1, further comprising a discrimination circuit elecrically connected to said detecting unit for receiving electric signals therefrom and for discriminating between non-defective sliders and defective sliders based on the electric signals from said detecting unit.

14. An apparatus for inspecting automatic lock sliders used in slide fasteners, comprising:

(A) a disk-like turntable intermittently tunable on its vertical axis and having a plurality of recesses in and along a peripheral edge thereof at predetermined distances for receiving the sliders one in each of said recesses;

(B) a reciprocating support block disposed above said table and adapted to be reciprocated vertically at a predetermined stroke while said table is at a stop, the reciprocating support block having a hollow chamber therein;

(C) a rack member attached to said reciprocating support block as allowed to reciprocate vertically and elastically urged downwardly and adapted to cease its downward movement when said reciprocating support block has descended over a prescribed distance;

(D) an auxiliary support block having a rack part and said auxiliary support block attached slidably to said reciprocating support block so as to be vertically reciprocated above the slider held on said table;

(E) a train of gears disposed inside said hollow chamber and supported on said reciprocating support block, the train of gears being meshed on one side with teeth of said rack member and on the other side with teeth of the rack part of said auxiliary support block so as to reverse a rotating force transmitted from said rack member and transmit the reversed rotating force to the rack part of said auxiliary support block;

(F) a retainer rod for retaining a slider body, the retainer rod being attached to said auxiliary support block as allowed to reciprocate vertically at a position aligned with a body of the slider held on said table and elastically urged downwardly;

(G) a sensor lever pivotally supported on said retainer rod and extended in a substantially horizontal direction, the sensor lever having a sensing projection extended downwardly from a lower side thereof at a position aligned with a pull tab of the slider held on said table;

(H) a pressure rod for pressing the pull tab of the slider held on said table, the pressure rod being attached to said auxiliary support block as allowed to reciprocate vertically at a position aligned with the pull tab of the slider held on said table and elastically urged downwardly; and (I) a detecting unit disposed within a range in which a free end of said sensor lever is vertically movable in response to the pivotal movement of said pull tab of the slider and adapted to detect the motion of the free end of said sensor lever.

15. An apparatus according to claim 14, wherein said rack member and the rack part of said auxiliary support block are disposed inside said hollow chamber of the reciprocating support block in such a manner that toothed faces thereof may be opposed to each other.

16. An apparatus according to claim 14, wherein said pressure rod is provided in its lower part with forked parts adapted to be disposed astride said sensor lever.

17. An apparatus according to claim 14, wherein said detecting unit includes a pair of upper and lower non-contact type detectors having a pair of vertically aligned cutouts, respectively, for passage of the free end of said sensor lever, each of said upper and lower detectors having a light emitter disposed at one side of the respective cutout and a light receptor disposed at the other side thereof.

* * * * *